US007673869B2

(12) United States Patent
Hamahashi

(10) Patent No.: US 7,673,869 B2
(45) Date of Patent: Mar. 9, 2010

(54) IMAGE FORMING APPARATUS AND IMAGE FORMING METHOD, AND PROGRAM

(75) Inventor: Shunsuke Hamahashi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 380 days.

(21) Appl. No.: 11/649,670

(22) Filed: Jan. 3, 2007

(65) Prior Publication Data

US 2007/0158895 A1 Jul. 12, 2007

(30) Foreign Application Priority Data

Jan. 5, 2006 (JP) ..... 2006-000751

(51) Int. Cl.
*B65H 5/00* (2006.01)

(52) U.S. Cl. ..... 271/10.03; 271/114

(58) Field of Classification Search ..... 271/10.03, 271/114

See application file for complete search history.

(56) References Cited

U.S. PATENT DOCUMENTS 4,110,032 A * 8/1978 Hubbard et al. ..... 399/18
4,444,385 A * 4/1984 Berry ..... 271/22
5,194,970 A * 3/1993 Iwanade ..... 358/498
5,531,435 A * 7/1996 Momose ..... 271/258.03
5,921,539 A * 7/1999 Westcott et al. ..... 271/10.03
5,934,661 A * 8/1999 Kameyama ..... 271/4.08
6,032,944 A * 3/2000 Lee ..... 271/110
6,786,481 B2 * 9/2004 Kawai et al. ..... 271/109
7,156,387 B2 * 1/2007 Hidaka et al. ..... 271/10.02
2003/0173736 A1 * 9/2003 Yano ..... 271/264

FOREIGN PATENT DOCUMENTS

JP 11-10972 1/1999
JP 11-334935 12/1999
JP 2001-47703 2/2001

* cited by examiner

*Primary Examiner*—Patrick H Mackey
*Assistant Examiner*—Jeremy Severson
(74) *Attorney, Agent, or Firm*—Cooper & Dunham, LLP

(57) ABSTRACT

An image forming apparatus includes a sheet mounting part for mounting plural sheets thereon, a sheet feeding part having a sheet feeding roller for feeding one of the plural sheets mounted on the sheet mounting part to a sheet conveying path by rotating the sheet feeding roller, a sheet detecting part for detecting the sheet fed by the sheet feeding part on the sheet conveying path, and a control part for controlling the rotation of the sheet feeding roller. The sheet feeding roller repeats an operation of rotating and stopping in a predetermined interval in accordance with the control of the control part during a period which begins when starting the feeding of the sheet and ends when detecting the sheet on the sheet conveying path.

5 Claims, 5 Drawing Sheets

IMAGE FORMING APPARATUS AND IMAGE FORMING METHOD, AND PROGRAM

BACKGROUND OF THE INVENTION

1. Technical Field

This disclosure relates to an image forming apparatus, an image forming method, and a program.

2. Description of the Related Art

In a conventional image forming apparatus, a sheet feeding operation is performed by a sheet feeding part that uses, for example, a stepping motor, in which the sheet feeding part feeds a sheet(s) of paper placed on a sheet stacking part. In a case where the sheet is not detected by a sheet detecting part situated on a sheet conveying path within a predetermined period of time, the sheet feeding operation is retried (hereinafter referred to as "sheet-feed retry operation") for a plural number of times. When retrying the sheet feeding operation, the number of rotations of the stepping motor is gradually increased, in which the stepping motor is driven below a predetermined number of rotations (rotational speed) until a front end of the sheet is detected. After the front end of the sheet is detected, the number of rotations is gradually increased to that of a normal driving state (See Japanese Laid-Open Patent Application No. 11-010972).

However, with the conventional image forming apparatus, the sheet-feed retry operation is executed after having the sheet detecting part wait for a predetermined period of time to elapse. Therefore, it takes a long time for a single sheet-feed retry operation to be executed. As a result, in a case, for example, where a sheet feeding roller is worn out, a further amount of time would be required since the sheet-feed retry operation is executed repetitively until the front end of the sheet can be detected.

SUMMARY

There is provided in an embodiment of this disclosure an image forming apparatus including a sheet mounting part for mounting a plurality of sheets thereon, a sheet feeding part having a sheet feeding roller for feeding one of the plural sheets mounted on the sheet mounting part to a sheet conveying path by rotating the sheet feeding roller, a sheet detecting part for detecting the sheet fed by the sheet feeding part on the sheet conveying path, and a control part for controlling the rotation of the sheet feeding roller, wherein the sheet feeding roller repeats an operation of rotating and stopping in a predetermined interval in accordance with the control of the control part during a period which begins when starting the feeding of the sheet and ends when detecting the sheet on the sheet conveying path.

In the image forming apparatus according to an embodiment of this disclosure, during the predetermined interval, the control part may control the rotation of the sheet feeding roller so that the rotational speed of the sheet feeding roller changes from stopped to a predetermined rotational speed.

In the image forming apparatus according to an embodiment of this disclosure, the control part may include a calculating part for calculating the amount of friction between the sheet and the sheet feeding roller, and a setting part for setting the number of times of repeating the operation of rotating and stopping the sheet feeding roller based on the calculated amount of friction.

In the image forming apparatus according to an embodiment of this disclosure, the calculation of the calculating part may include calculating the frictional coefficient based on the type of the sheet, the material of the sheet feeding roller, and the wear status of the sheet feeding roller, wherein the setting of the setting part may include setting the number of times of repeating the operation of rotating and stopping the sheet feeding roller based on the calculated frictional coefficient.

In another embodiment of this disclosure, there is provided an image forming method including the steps of: a) feeding one of a plurality of sheets mounted on a sheet mounting part to a sheet conveying path by rotating a sheet feeding roller; b) detecting the sheet fed in step a) on the sheet conveying path; and c) controlling the rotation of the sheet feeding roller; wherein the sheet feeding roller repeats an operation of rotating and stopping in a predetermined interval in accordance with the control of the control part during a period which begins when starting the feeding of the sheet and ends when detecting the sheet on the sheet conveying path.

In the image forming method according to an embodiment of this disclosure, during the predetermined interval, the rotation of the sheet feeding roller may be controlled in step c) so that the rotational speed of the sheet feeding roller changes from stopped to a predetermined rotational speed.

In the image forming method according to an embodiment of this disclosure, step c) may include the steps of d) calculating the amount of friction between the sheet and the sheet feeding roller, and c) setting the number of times of repeating the operation of rotating and stopping the sheet feeding roller based on the calculated amount of friction.

In the image forming method according to an embodiment of this disclosure, the calculation in step d) may include calculating the frictional coefficient based on the type of the sheet, the material of the sheet feeding roller, and the wear status of the sheet feeding roller, wherein the setting in step e) may include setting the number of times of repeating the operation of rotating and stopping the sheet feeding roller based on the calculated frictional coefficient.

In another embodiment of this disclosure, there is provided a program for causing a computer to execute an image forming method, the image forming method including the steps of: a) feeding one of a plurality of sheets mounted on a sheet mounting part to a sheet conveying path by rotating a sheet feeding roller; b) detecting the sheet fed in step a) on the sheet conveying path; and c) controlling the rotation of the sheet feeding roller; wherein the sheet feeding roller repeats an operation of rotating and stopping in a predetermined interval in accordance with the control of the control part during a period which begins when starting the feeding of the sheet and ends when detecting the sheet on the sheet conveying path.

Other aspects and further features will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
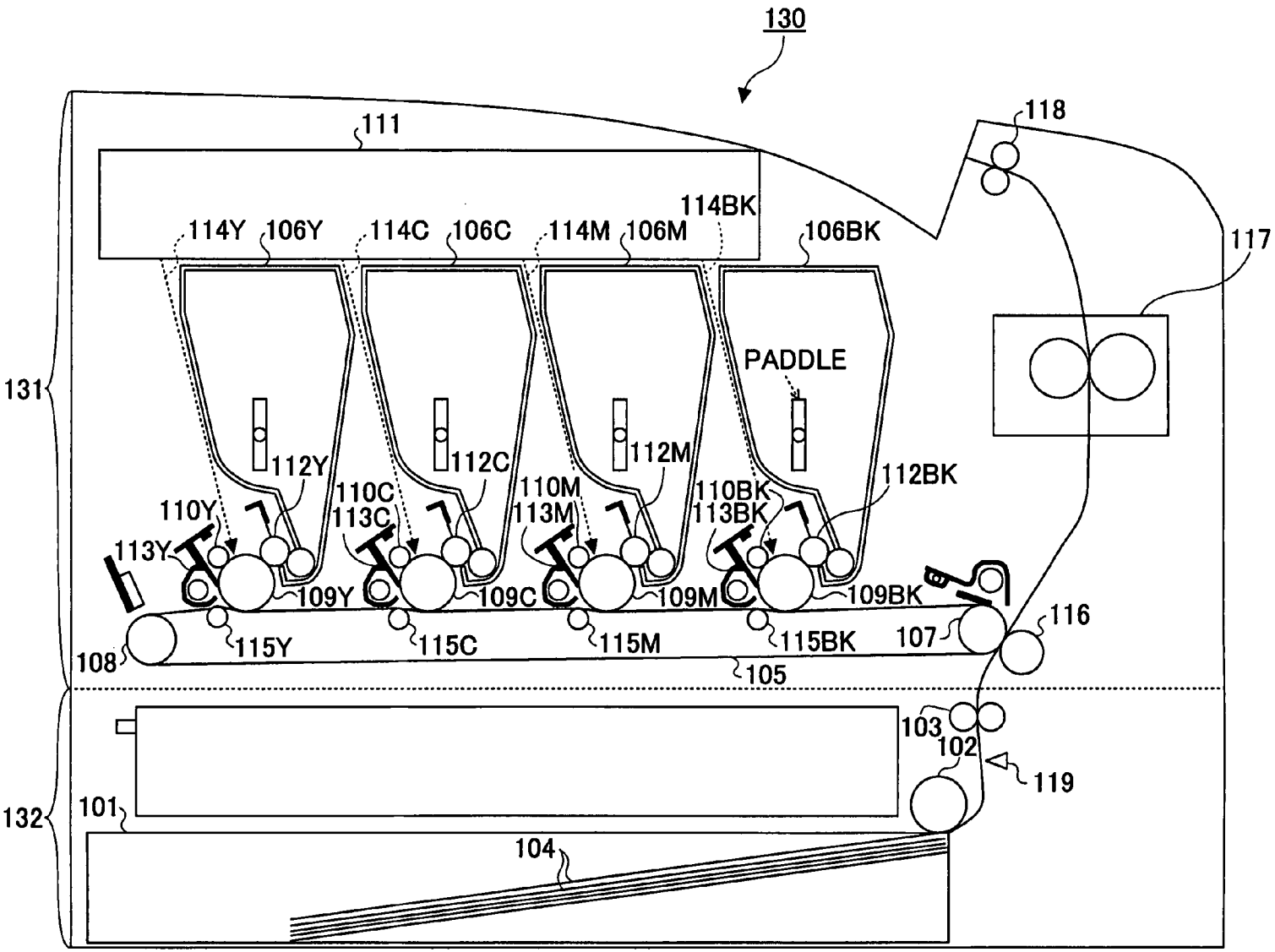
FIG. 1 is a schematic diagram showing an exemplary configuration of an image forming apparatus according to an embodiment of the present invention.

FIG. 1 is a schematic diagram showing a configuration (functional configuration) of an image forming apparatus according to an embodiment of the present invention. The image forming apparatus 130 according to an embodiment of the present invention includes an image forming part 131 and a sheet feeding part 132.

The image forming part 131 includes a transfer belt 105, an ink cartridge 106, a second transfer driving roller 107, a transfer belt tension roller 108, a photoconductor 109, a charging part 110, an exposing part 111, a developing part 112, a cleaner blade 113, a first transfer roller 115, a second transfer roller 116, a fixing part 117, and sheet discharging rollers 118.

The ink cartridge 106 includes plural ink cartridges (106BK, 106M, 106C, 106Y) corresponding to each color that are arranged along the transfer belt 105. The ink cartridges are for a tandem type image forming apparatus. The transfer belt 105 rotates in a counter-clockwise direction in FIG. 1. The plural ink cartridges 106BK, 106M, 106C, 106Y are arranged in order from an upstream side of the rotating direction of the transfer belt 105. Except for being configured to form toner images of different color, the inside configurations of the plural ink cartridges 106BK, 106M, 106C, 106Y are the same. The ink cartridge 106BK forms black color images, the ink cartridge 106M forms magenta color images, the ink cartridge 106C forms cyan color images, and the ink cartridge 106Y forms yellow color images.

Although a configuration of the ink cartridge 106BK is described in detail below, it is to be noted that the configuration of the ink cartridges 106M, 106C, and 106Y is the same as that of the ink cartridge 106BK. Therefore, the components of the ink cartridges 106M, 106C, 106Y are respectively denoted with M, C, Y instead of BK in the drawings but are not described below.

The transfer belt 105 is wound around the second transfer driving roller 107 and the transfer belt tension roller 108. The second transfer driving roller 107 is rotatively driven by a driving motor (not shown). The driving motor (not shown), the second transfer driving roller 107, and the transfer belt tension roller 108 function as a driving part for moving the transfer belt 105.

The photoconductor 109BK, the charging part 110BK, the exposing part 111, the developing part 112BK, and the cleaner blade 113BK, for example, are arranged in the periphery of the ink cartridge 106BK. The exposing part 111 irradiates laser beams 114BK, 114M, 114C, 114Y corresponding to the color of the images formed by the respective ink cartridges 106BK, 106M, 106C, and 106Y.

In an image forming operation, the outer peripheral surface of the photoconductor 109BK is evenly charged by the charging part 110BK. Then, the exposing part 111 irradiates a laser beam 114BK corresponding to the color of the black image and exposes the evenly charged outer peripheral surface of the photoconductor 109BK. Thereby, an electrostatic latent image is formed. The developing part 112BK makes the electrostatic latent image visible by applying black toner to the electrostatic latent image. Thereby, a black toner image is formed on the photoconductor 109BK.

The first transfer roller 115 BK transfers the black toner image to the transfer belt 105 at a position where the photoconductor 109BK and the transfer belt 105 make contact (first transfer position). By performing the transfer, the black toner image can be formed on the transfer belt 105. After the transfer of the toner image is finished, the cleaner blade 113BK removes unwanted residual toner remaining on the outer peripheral surface of the photoconductor 109BK. After the residual toner is removed, the photoconductor 109BK stands by for the next image forming operation.

Accordingly, the transfer belt 105 having the black toner image transferred thereto at the ink cartridge BK is conveyed (moved) to the next ink cartridge (in this example, ink cartridge 106M). Then, the same image forming operation performed in the ink cartridge 106BK is performed in the ink cartridge 106M. That is, a magenta toner image is formed on the photoconductor 109M and then the magenta toner image is transferred to the transfer belt 105 in a manner superposed on the black image on the transfer belt 105.

Likewise, the transfer belt 105 is conveyed to the next ink cartridges 106C and 106Y. The ink cartridges 106C and 106Y perform the same image forming operation as those of the ink cartridges 106BK, 106M. Accordingly, the cyan toner image formed on the photoconductor 109C and the yellow toner image formed on the photoconductor 109Y are transferred in a superposing manner on the transfer belt 105. Thereby, a full color image can be formed on the transfer belt 105. The transfer belt 105 having the superposed image formed thereon is conveyed to a position of the second transfer roller 116. Then, the full color image formed on the transfer belt 105 is transferred to a below-described sheet 104.

The fixing part 117 thermal fuses the toner images transferred to the sheet 104 so that the toner image can be fixed to the sheet 104. The sheet 104 having the toner image fixed thereto is discharged out of the image forming apparatus 130 by the sheet discharging roller 118 as a printing result.

In a case of forming (printing) a black color image, the first transfer rollers 115M, 115C, 115Y are moved to a position separated from the photoconductors 109M, 109C, and 109Y so that the image forming operation only for printing black can be performed.

Next, a configuration (functional configuration) of the sheet feeding part 132 is described. The sheet feeding part 132 includes a sheet feed tray 101, a sheet feeding roller 102, a resist roller(s) 103, a sheet(s) of paper 104, and a resist sensor 119.

The sheet feed tray 101 has a sheet(s) of paper 104 mounted thereon. The sheet feeding roller 102 feeds the sheet 104 mounted on the sheet feed tray 101 to the image forming part 131. The sheet feeding roller 102 performs sheet feeding by utilizing static friction having a greater frictional coefficient than dynamic friction. This causes static friction between the first sheet of paper and the second sheet of paper. This increases the probability of double (overlapping) feeding the two sheets of paper. Accordingly, a friction pad having high friction is mounted on the sheet feed tray 101 at an opposite side of the sheet feeding roller 102 for sandwiching the sheet of paper 104 therebetween.

Thereby, the friction pad serves to reliably separate the first and second sheets of paper so as to prevent double (overlapping) feeding the two sheets of paper. Thus, in a case where two sheets of paper are doubly fed from the sheet feed tray 101, the first sheet contacts the sheet feeding roller 102 and the second sheet is attached to the friction pad. In this state, the frictional force between the first sheet and the sheet feeding roller 102 is greater than the frictional force between the first and second sheets. Therefore, only the first sheet is fed by the sheet feeding roller 102 and the second sheet is left to remain in the sheet feed tray 101 by the friction pad. Accordingly, double feeding of the two sheets of paper can be prevented.

The resist rollers 103 create a bending of the sheet 104 between the sheet feeding roller 102 and feeds the sheet 104 to the second transfer roller 116 in correspondence with the timing of transferring an image by the image forming part 131. The resist sensor 119 detects the front end of the sheet 104 fed from the sheet feed tray 101 by the sheet feeding roller 102.

Figure 2:
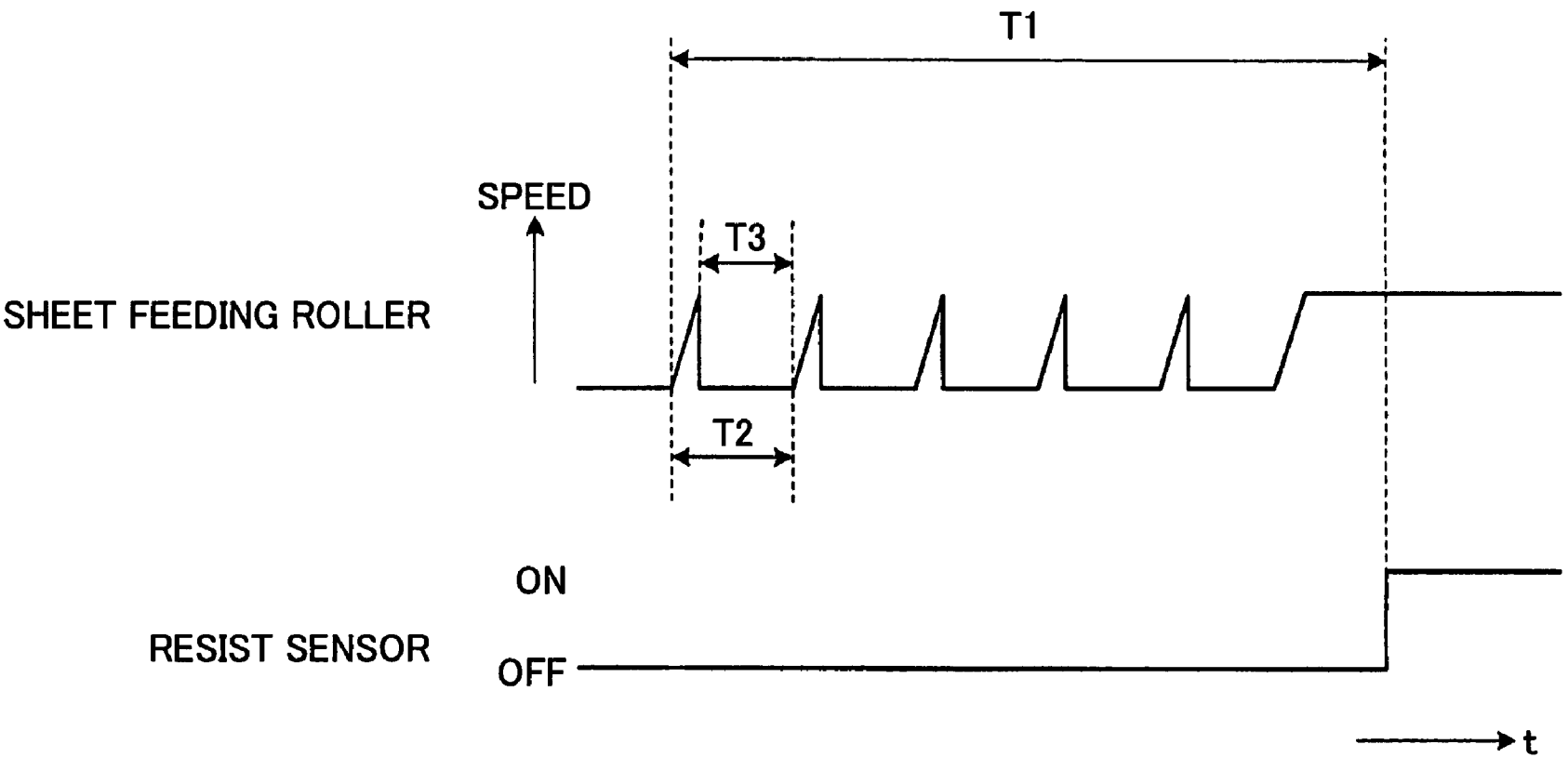
FIG. 2 is a schematic diagram for describing the timing of controlling a sheet feeding roller with a stepping motor according to an embodiment of the present invention.

Next, the timing for controlling the sheet feeding roller 102 of the sheet feeding part 132 according to an embodiment of the present invention is described with reference to FIG. 2. The sheet feeding part 132 uses a stepping motor, for example, for controlling the rotation of the sheet feeding roller 102. FIG. 2 is a schematic diagram showing the timing for controlling the sheet feeding roller 102 with the stepping motor. The rotational speed of the stepping motor is changeable. The sheet feeding part 132 controls the rotational speed of the stepping motor in accordance with a sheet feed motor signal 308 (described below). For example, the rotational speed of the stepping motor is controlled to be a slow rotational speed at the beginning period of rotation and is gradually increased to a predetermined speed.

The sheet feeding roller 102 repeats an operation of rotating and stopping in predetermined intervals in accordance with the sheet feed motor signal(s) 308. In this embodiment of the present invention, the distance between the sheet feeding roller 102 and the resist sensor 119 is expressed as "L" [mm], the linear speed of the sheet feeding roller 102 is expressed as "S" [mm/sec], the interval in which the operation of rotating and stopping of the sheet feeding roller 102 is executed is expressed as "T2" [sec], and the time in which the sheet feeding roller 102 is stopped during a single interval is expressed as "T3" [sec]. In a case where this operation is repeated for "n" times, the period (time) which begins when the sheet feeding roller 102 starts to feed the sheet and ends when the resist sensor detects the sheet on the sheet conveying path is expressed as "T1" [sec]. Accordingly, "T1" can be expressed as "$L/S+T2\times n$". Hereinafter the operation (control) of repeating "T2" is referred to as "sheet feed on/off control". Furthermore, the number of times of repeating the operation of "T2" is hereinafter referred to as "number of times for sheet feed on/off control".

Figure 3:
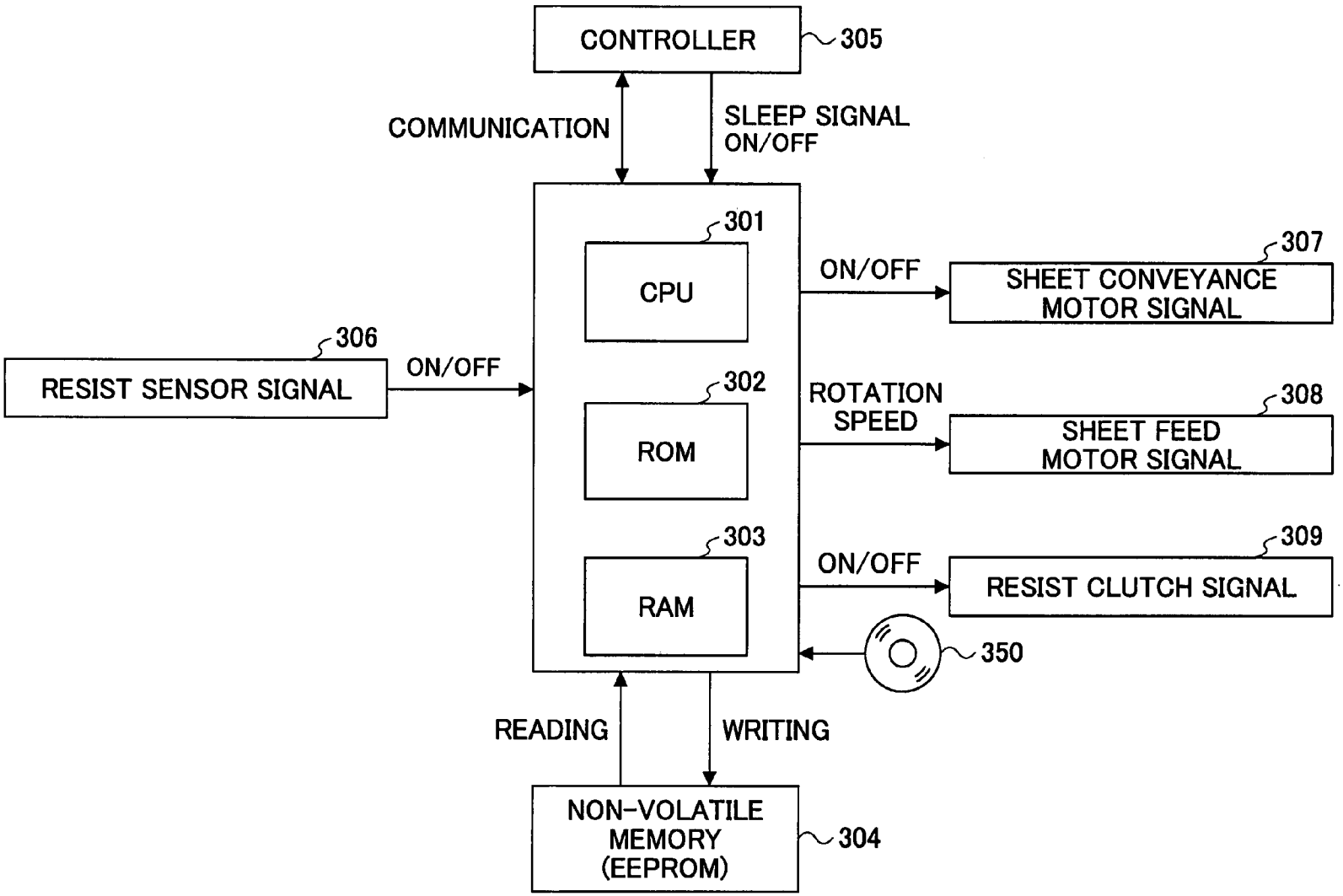
FIG. 3 is a schematic diagram showing a hardware configuration of a sheet feeding part according to an embodiment of the present invention.

FIG. 3 illustrates a hardware configuration of a sheet feeding part 132 according to an embodiment of the present invention. The sheet feeding part 132 includes, for example, a CPU 301, a ROM 302, a RAM 303, and a non-volatile memory (EEPROM) 304, and a controller 305.

The CPU 301 sets the number of times for sheet feed on/off control and controls the on and off of the sheet feeding operation. Furthermore, the CPU 301 obtains a resist sensor signal (s) 306 from the resist sensor 119. The CPU 301 obtains the resist sensor signal 306 when the resist sensor 119 detects the front end of the sheet 104.

Furthermore, the CPU 301 outputs a control signal(s) for controlling the rotation of the sheet feeding roller 102. The control signal for controlling the rotation of the sheet feeding roller 102 includes, for example, a sheet conveyance motor signal 307, a sheet feed motor signal 308, and a resist clutch signal 309. The sheet conveyance motor signal 307 is for rotating the sheet feeding roller 102 at a constant speed. The sheet feed motor signal 308 is for controlling the rotational speed of the sheet feeding roller 102 with a stepping motor. The resist clutch signal 309 is for stopping the rotation of the sheet feeding roller 102.

The data recorded in the ROM 302 include, for example, data of a table indicative of the relationship between frictional coefficient and the type of sheet 104 and/or the material of the sheet feeding roller 102, and data of the time set to a jam timer (described below). The data recorded to the RAM 303 include, for example, data of number of fed sheets of paper (fed sheets) 104, and data of a table indicative of the relationship between the number of fed sheets 104 and the degree of wear according to the material of the roller. The data recorded to the non-volatile memory 304 include, for example, data of the material of the sheet feeding roller 102 and data of frictional coefficients corresponding to the material of the sheet feeding roller 102. Furthermore, in the non-volatile memory 304 is also recorded the number of times of sheet feed on/off which is set by the CPU 301.

[Operation of Sheet Feeding Part]

Figure 4:
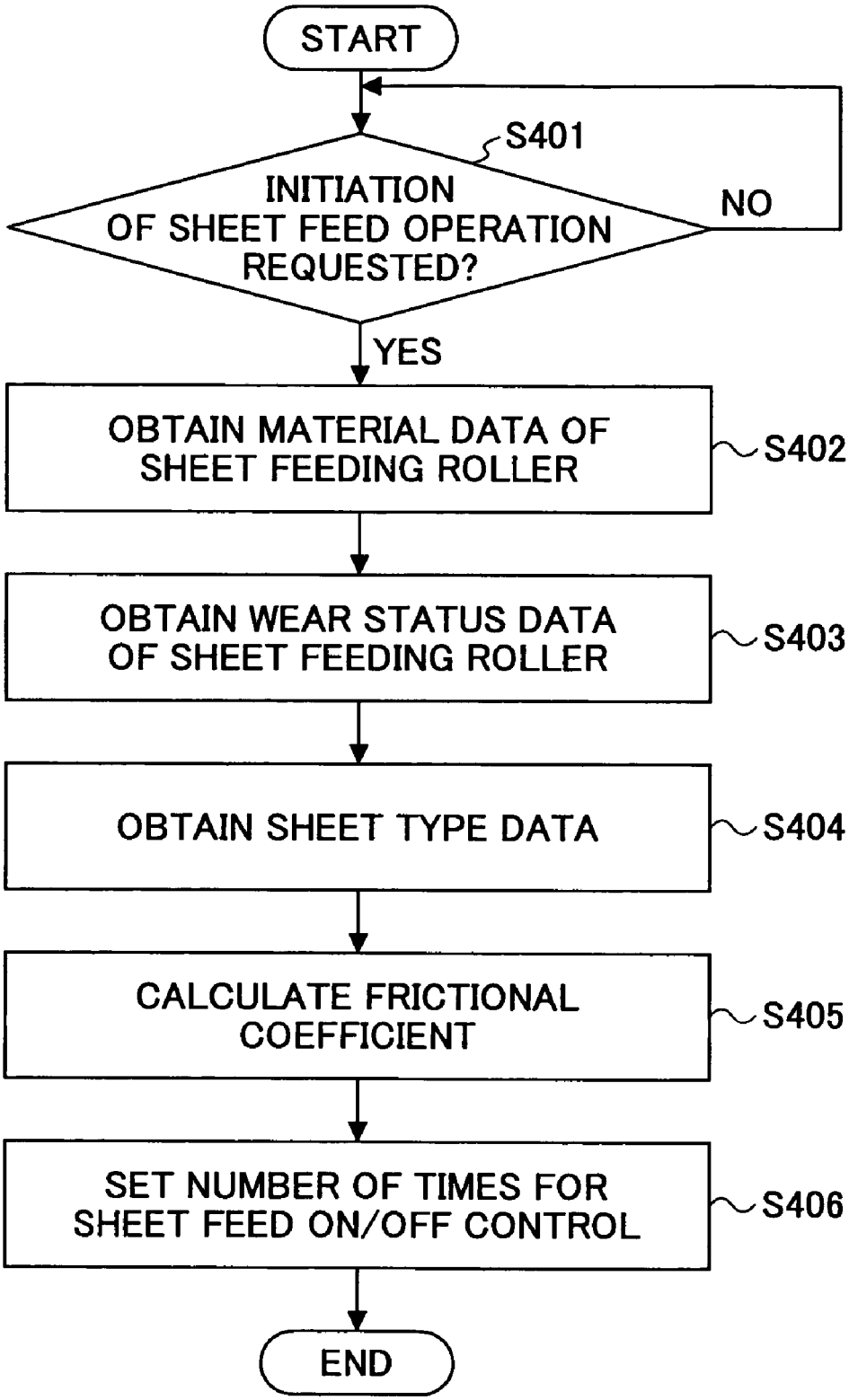
FIG. 4 is a flowchart for describing an operation of setting the number of times of sheet feed on/off control of a sheet feeding part according to an embodiment of the present invention.

Next, operations of the sheet feeding part 132 according to an embodiment of the present invention are described with reference to FIGS. 4 and 5. FIG. 4 is a flowchart showing an operation for setting the number of sheet feed on/off control cycles performed by the sheet feeding part 132 according to an embodiment of the present invention. In the flowchart shown in FIG. 4, the CPU 301 determines whether a request for initiation of the sheet feed operation has been received (Step S401). The request for initiation of the sheet feed operation may be made by having the user operate the controller 305.

In a case where the sheet feed operation request is received (Yes in Step S401), the CPU 301 obtains material data of the sheet feeding roller 102 (Step S402). The material of the sheet feeding roller 102 is recorded beforehand in the non-volatile memory 304.

Furthermore, the CPU 301 obtains wear status data of the sheet feeding roller 102 (Step S403). The wear status of the sheet feeding roller 102 is obtained by recording the number of fed sheets in the RAM 303 and using the table indicative of the relationship between the number of fed sheets and the degree of wear of the material of the roller. It is to be noted that this table is also recorded in the RAM 303.

Furthermore, the CPU 301 obtains the sheet type data (Step S404). The type of sheets may be obtained by having the user operate the controller 305. The obtained type of sheet is recorded to the non-volatile memory 304.

Then, the CPU 301 calculates the frictional coefficient (Step S405). The CPU 301, while taking the wear status of the sheet feeding roller 102 into consideration, calculates the frictional coefficient by referring to the table indicative of the relationship between frictional coefficient and the type of sheet 104 and/or the material of the sheet feeding roller 102. The table is recorded in the ROM 302. Furthermore, the calculated frictional coefficient is recorded in the non-volatile memory 304.

Accordingly, the CPU 301 sets the number of sheet feed on/off control cycles to be executed (Step S406). The number of sheet feed on/off controls to be executed is set based on the frictional coefficient calculated in Step S405. In setting the number of sheet feed on/off control cycles to be executed, the CPU 301 refers to data of frictional coefficients calculated in the past and their corresponding number of sheet feed on/off control cycles. The set number of sheet feed on/off control cycles is recorded to the non-volatile memory 304.

It is to be noted that at least one of the Steps S402-S404 is to be executed for calculating the frictional coefficient in Step S405. That is, at least one of the material data of the sheet feeding roller 102, the wear status data of the sheet feeding roller 102, and the sheet type data is to be obtained for calculating frictional coefficient.

Furthermore, in Step S403, although it is described above that the table indicative of the number of sheets fed in the past and the degree of wear due to the material of the roller is recorded in the RAM 303, the table may alternatively be recorded in the ROM 302, or the non-volatile memory 304.

Likewise, in Step S405, although it is described above that the table indicative of the relationship between frictional coefficient and the type of sheet 104 and/or the material of the sheet feeding roller 102 is recorded in the ROM 302, the table may alternatively be recorded in the RAM 303 or the non-volatile memory 304.

Figure 5:
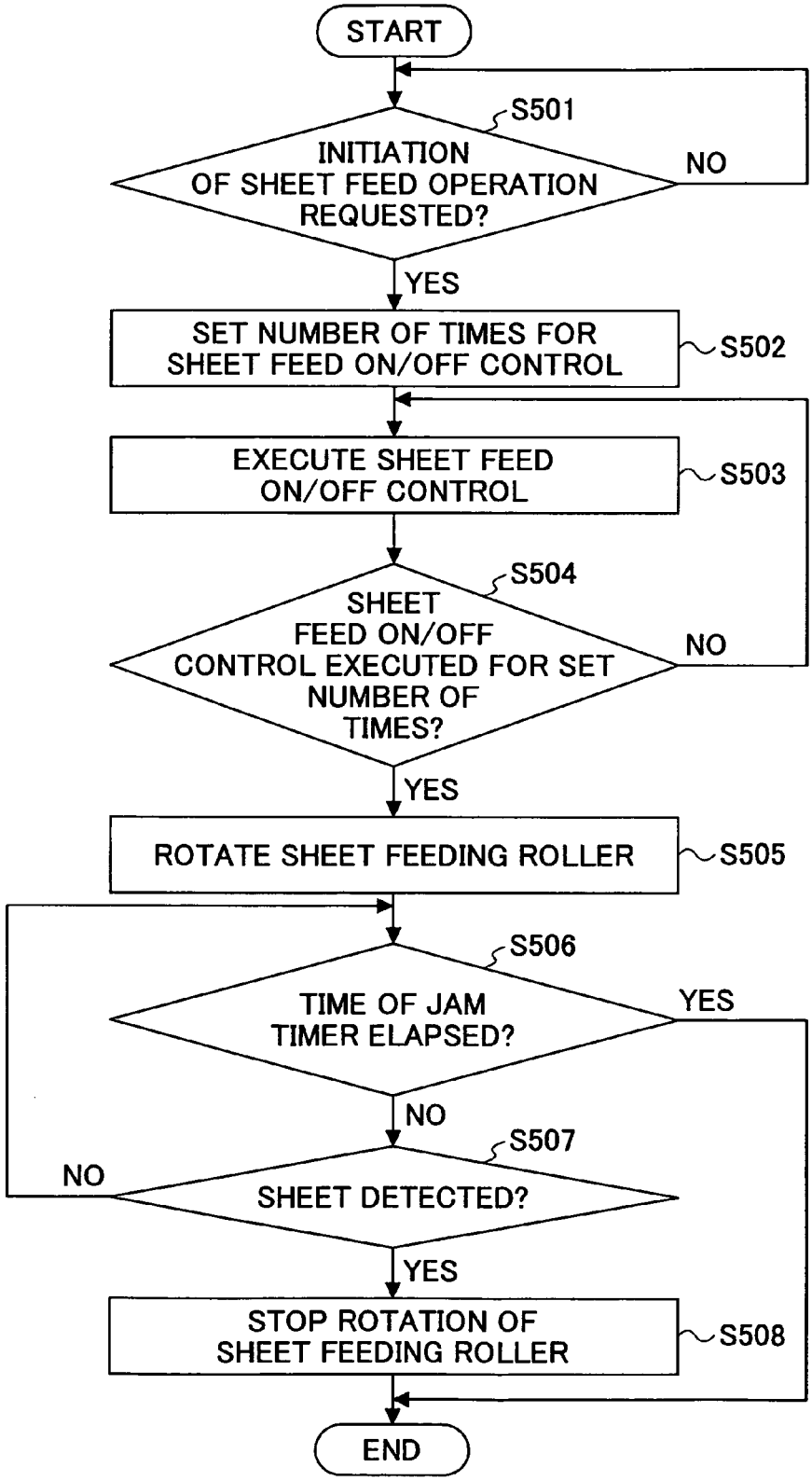
FIG. 5 is a flowchart for describing an operation of sheet feeding with a sheet feeding part according to an embodiment of the present invention.

FIG. 5 is a flowchart showing a sheet feeding operation executed by the sheet feeding part 132 according to an embodiment of the present invention. In the flowchart shown in FIG. 5, the CPU 301 determines whether a request for initiation of the sheet feed operation has been received (Step S401). The request for initiation of the sheet feed operation may be made by having the user operate the controller 305.

In a case where the sheet feed operation request is received (Yes in Step S501), the CPU 301 sets the number of sheet feed on/off controls to be executed (Step S502). Since the operation of setting the number of sheet feed on/off controls performed by the sheet feeding part 132 is basically the same as that shown in FIG. 4, explanation thereof is omitted.

Then, the CPU 301 executes the sheet feed on/off control (Step S503). More specifically, the CPU 301, in accordance with the sheet feed motor signal 308, controls the rotation of the sheet feeding roller 102 at a timing shown in FIG. 2. At this stage, the CPU 301 activates (initiates) a jam timer (described below).

Then, the CPU 301 determines whether the sheet feed on/off control has been executed for the number of times set in Step S502 (Step S504). In a case where the sheet feed on/off control is not executed for the set number of times (No in Step S504), the operation returns to Step S503.

Meanwhile, in a case where the sheet feed on/off control is executed for the set number of times (Yes in Step S504), the CPU 301 rotates the sheet feeding roller 102 (Step S505). More specifically, the CPU 301, in accordance with the sheet conveyance motor signal, rotates the sheet feeding roller 102 at a predetermined speed.

Then, the CPU 301 determines whether the time of the jam timer has elapsed (Step S506). The time of the jam timer is set beforehand by the user and is recorded in, for example, the ROM 302. In a case where the time of the jam timer has elapsed (Yes in Step S506), the CPU 301 stops the operation since the elapse signifies a sheet conveyance error (jam).

Meanwhile, in a case where the time of the jam timer has not elapsed (No in Step S506), the CPU 301 determines whether the sheet 104 has been detected (Step S507). The detection of the sheet 104 is performed by the resist sensor 119. Furthermore, the CPU 301 receives a resist sensor signal 306 from the resist sensor 119 when the resist sensor 119 detects the front end of the sheet 104.

In a case where the sheet 104 is not detected (No in Step S507), the operation returns to Step S506. In a case where the sheet 104 is detected (Yes in Step S507), the CPU 301 stops the sheet feeding roller 102 (Step S508). Thereby, the operation is finished. The CPU 309 stops the sheet conveying roller 102 by outputting a resist clutch signal. Furthermore, the sheet feeding roller 102 also stops when a bending of the sheet 104 is created by the resist roller 103.

The above-described embodiment of the present invention explains a case of controlling an operation of feeding a sheet 104 provided on a sheet conveying path between the sheet feed tray 101 to the resist roller 103, in which the sheet feeding roller 102 is stopped and the operation is finished in Step S508. When the sheet feeding operation is finished in Step S508, the sheet 104 is in a state contacting the sheet conveying roller 102 and the resist roller 103. Accordingly, in performing a subsequent sheet feeding operation, the sheet feeding roller 102 and the resist roller 103 are rotated simultaneously in correspondence with the timing in which the image forming part 131 transfers a toner image to the sheet 104. After the toner image is transferred to the sheet 104 by the image forming part 131, the fixing part 117 fixes the transferred image to the sheet 104. Then, the sheet 104 having the toner image fixed thereto is discharged out of the image forming apparatus 130 as a printing result.

Therefore, in the image forming apparatus (image forming method) according to the above-described embodiment of the present invention, the sheet conveying part can calculate the frictional coefficient between the sheet and the sheet feeding roller based on the material of the sheet feeding roller, the wear status of the sheet feeding roller, and the type of sheet. Thereby, the number of times executing for sheet feed on/off control can be determined based on the calculated frictional coefficient. Hence, the time for performing the sheet feed operation can be shortened by changing the number of times for executing sheet feed on/off control in accordance with the wear status of the sheet feeding roller.

It is to be noted that the above-described image forming method according to an embodiment of the present invention may be executed by a program causing a computer (e.g. personal computer, workstation) connected to an image forming apparatus to execute the image forming method. The program may be recorded in a hard disk or to a computer-readable recording medium 350 (e.g. flexible disk, CD-ROM, MO, DVD) for enabling the program to be read out by the computer. The program includes a medium that can be distributed through a network (e.g. the Internet).

As described above, with the image forming apparatus, the image forming method, and the program according to an embodiment of the present invention, sheet feed on/off control can be satisfactorily performed by calculating the frictional coefficient between the sheet and the sheet feeding roller and setting the number of times for executing sheet feed on/off control can be set according to the calculated frictional coefficient. Thereby, an image forming operation can be performed at high speed with few conveyance errors.

Hence, the image forming apparatus, the image forming method, and the computer-readable recording medium according to an embodiment of the present invention are beneficial for a digital copier having, for example, a copying function, a facsimile function, and a printer function, and more particularly, for a copier that reads and prints (outputs) documents.

Further, the present invention is not limited to these embodiments, but variations and modifications may be made without departing from the scope of the present invention.

The present application is based on Japanese Priority Application No. 2006-000751 filed on Jan. 5, 2006, with the Japanese Patent Office, the entire contents of which are hereby incorporated by reference.

What is claimed is:

1. An image forming apparatus comprising:

a sheet mounting part for mounting a plurality of sheets thereon;

a sheet feeding part having a sheet feeding roller for feeding one of the plural sheets mounted on the sheet mounting part to a sheet conveying path by rotating the sheet feeding roller;

a sheet detecting part for detecting the sheet fed by the sheet feeding part on the sheet conveying path; and a control part for repeating a first operation of rotating and stopping the sheet feeding roller in a predetermined interval and executing a second operation of rotating the sheet feeding roller at a predetermined speed after repeating the first operation, the first and second operations being executed during a period which begins when starting the feeding of the sheet and ends when detecting the sheet on the sheet conveying path, wherein the control part includes a calculating part for calculating the amount of friction between the sheet and the sheet feeding roller, and a setting part for setting the number of times of repeating the first operation based on the calculated amount of friction, and wherein the calculation of the calculating part includes calculating the frictional coefficient based on the type of the sheet, the material of the sheet feeding roller, and the wear status of the sheet feeding roller, wherein the setting of the setting part includes setting the number of times of repeating the first operation based on the calculated frictional coefficient.

2. The image forming apparatus as claimed in claim 1, wherein during the predetermined interval, the control part controls the rotation of the sheet feeding roller so that the rotational speed of the sheet feeding roller changes from stopped to a predetermined rotational speed.

3. An image forming method comprising the steps of:

repeating a first operation of rotating and stopping a sheet feeding roller in a predetermined interval;

executing a second operation of rotating the sheet feeding roller at a predetermined speed after repeating the first operation;

a) feeding one of a plurality of sheets mounted on a sheet mounting part to a sheet conveying path by rotating the sheet feeding roller;

b) detecting the sheet fed in step a) on the sheet conveying path;

c) controlling the rotation of the sheet feeding roller;

d) calculating the amount of friction between the sheet and the sheet feeding roller; and e) setting the number of times of repeating the first operation based on the calculated amount of friction, wherein the calculation in step d) includes calculating the frictional coefficient based on the type of the sheet, the material of the sheet feeding roller, and the wear status of the sheet feeding roller, wherein the setting in step e) includes setting the number of times of repeating the first operation based on the calculated frictional coefficient, and wherein the first and second operations are executed during a period which begins when starting the feeding of the sheet and ends when detecting the sheet on the sheet conveying path.

4. The image forming method as claimed in claim 3, wherein during the predetermined interval, the rotation of the sheet feeding roller is controlled in step c) so that the rotational speed of the sheet feeding roller changes from stopped to a predetermined rotational speed.

5. A computer readable recording medium on which a program for causing a computer to execute an image forming method is recorded, the image forming method comprising the steps of:

repeating a first operation of rotating and stopping a sheet feeding roller in a predetermined interval;

executing a second operation of rotating the sheet feeding roller at a predetermined speed after repeating the first operation;

a) feeding one of a plurality of sheets mounted on a sheet mounting part to a sheet conveying path by rotating the sheet feeding roller;

b) detecting the sheet fed in step a) on the sheet conveying path;

c) controlling the rotation of the sheet feeding roller;

d) calculating the amount of friction between the sheet and the sheet feeding roller; and e) setting the number of times of repeating the first operation based on the calculated amount of friction, wherein the calculation in step d) includes calculating the frictional coefficient based on the type of the sheet, the material of the sheet feeding roller, and the wear status of the sheet feeding roller, wherein the setting in step e) includes setting the number of times of repeating the first operation based on the calculated frictional coefficient, wherein the sheet feeding roller repeats an operation of rotating and stopping in a predetermined interval in accordance with the control of the control part during a period which begins when starting the feeding of the sheet and ends when detecting the sheet on the sheet conveying path, and wherein the first and second operations are executed during a period which begins when starting the feeding of the sheet and ends when detecting the sheet on the sheet conveying path.

* * * * *